United States Patent [19]

Lafontaine

[11] Patent Number: 4,750,294

[45] Date of Patent: Jun. 14, 1988

[54] SAFETY MECHANISM FOR POWER OPERATED DOOR

[76] Inventor: Lucien Lafontaine, 755 Mont Pellier, Apt. No. 1105, Ville St-Laurent, Que., Canada, H4L 4R1

[21] Appl. No.: 73,100

[22] Filed: Jul. 14, 1987

[51] Int. Cl.[4] ..... E05F 15/10; E05F 11/00

[52] U.S. Cl. ..... 49/28; 49/14; 49/199; 49/358

[58] Field of Search ..... 49/358, 199, 200, 14, 49/28, 360; 160/188, 189

[56] References Cited

U.S. PATENT DOCUMENTS

| | | | |
|---|---|---|---|
| 2,925,267 | 2/1960 | Volf | 268/59 |
| 3,202,415 | 8/1965 | Lodge | 268/59 |
| 3,284,952 | 11/1966 | Lodge | 49/360 |
| 3,633,313 | 1/1972 | Lafontaine | 49/199 |
| 3,691,684 | 9/1972 | Boneck | 49/28 X |
| 3,797,171 | 3/1974 | Farmer | 49/199 X |
| 4,107,877 | 8/1978 | Lee | 49/28 |
| 4,533,905 | 8/1985 | Leivenzon et al. | 49/14 X |
| 4,625,456 | 12/1986 | Lafontaine | 49/358 |

*Primary Examiner*—Philip C. Kannan

*Attorney, Agent, or Firm*—Neil W. McDermid; William H. James

[57] ABSTRACT

A safety mechanism for a power operated door activates limit switches for stopping an electric motor or reverses it's polarity. The safety mechanism is more compact than existing types of mechanisms and is suitable for friction drive roller garage door openers. Furthermore, indicator lights are provided that indicates exactly when a limit switch is tripped enabling field adjustment of the safety mechanism to suit specific pressures to either stop or reverse the door. The mechanism includes a worm slidably mounted on a motor drive shaft, with a cage structure around the worm to slide with the worm, two compression springs supporting the cage structure in a neutral position, an actuator member on the cage structure to activate limit switches when the cage structure slides in either direction, and adjustment screws to vary the position of the limit switches, each limit switch having an indicator light indicating when the switch is activated.

4 Claims, 5 Drawing Sheets

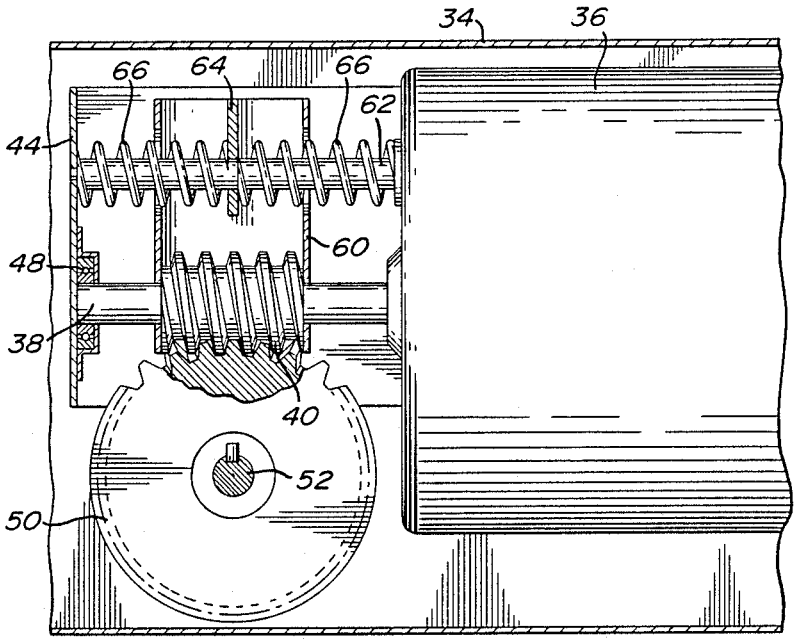
FIG. 3
FIG. 5
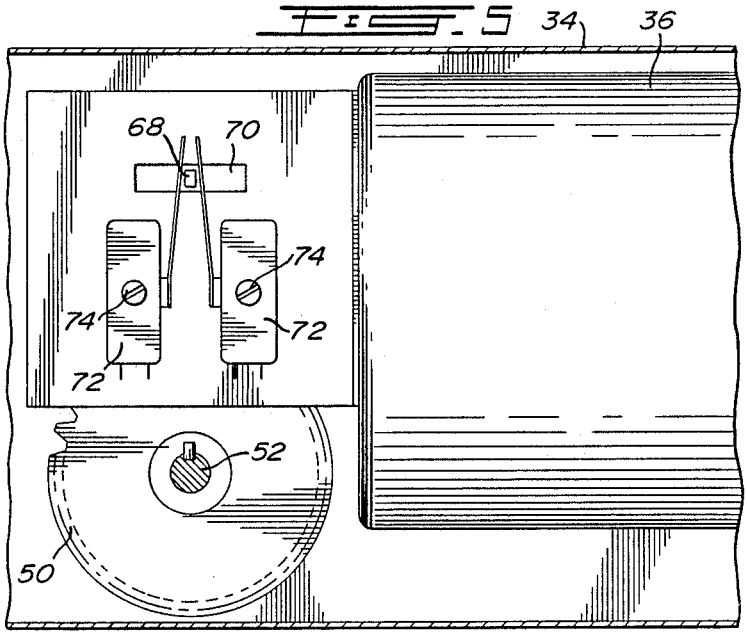

SAFETY MECHANISM FOR POWER OPERATED DOOR

The present invention relates to a power door operating device for use with a vertical sliding door and more specifically to a safety mechanism for stopping or reversing an electric motor powering the opening or closing of a vertical sliding door.

Powered garage door openers are used to raise and lower vertical sliding doors for garages and the like. Most garage doors have a series of horizontally divided panels supported on two guide tracks, one on each side. There are innumerable types of operating devices, one such embodiment is shown in my U.S. Pat. No. 4,625,456 wherein a friction drive roller drives the door up and down on one of the two guide tracks. In another case, a chain or wire cable mechanism operates the door opener. In all cases, it is necessary to have a safety mechanism so that if the door hits an obstruction on the way down, it either stops or reverses without damaging an individual or an object underneath the door. For this reason, most garage doors have rubber strips along the base to ensure that they do not scratch a car surface or the like. Similarly most door operating devices also have a mechanism wherein if the door sticks on the way up, it will automatically switch off the motor, thus stopping movement.

One safety mechanism for activating a limit switch or switches for stopping an electric motor or reversing its polarity, is shown in my U.S. Pat. No. 3,633,313.

It is an aim of the present invention to provide a stopping or reversing mechanism for a power door operating device which is more compact than heretofore provided and is applicable to all types of power door operating devices utilizing an electric motor driving a worm and worm gear.

A still further aim of the present invention is to provide a stopping or reversing mechanism for a power door operating device which has indicator lights that indicate exactly when a limit switch has tripped to permit field adjustment of the safety mechanism so that one can visually see and set the position of the limit switch to suit specific pressures to either stop or reverse the door. In the past, the adjustment of the pressure that triggers the limit switch, has been somewhat arbitrary in that one does not have a clear indication as to when the mechanism trips, but with the present stopping or reversing mechanism one can adjust the position of the limit switch until the desired sensitivity for a particular door is obtained.

The present invention provides in a power door operating device for use with a vertical sliding door, including a door opening and closing means, the improvement of a stopping or reversing mechanism for the sliding door comprising: a reversable electric motor having a motor drive shaft extending therefrom; a worm slidably mounted on the motor drive shaft, and held in rotational engagement to the motor drive shaft; a worm gear in working engagement with the worm, the worm gear locked onto a power drive shaft connected to the door opening and closing means; a cage structure around the worm adapted to slide with the worm; two compression springs supporting the cage structure so that at the neutral position, the worm is at the about mid point of engagement with the worm gear, such that slidable movement of the worm on the motor shaft compresses one spring if slid in one direction and the other spring if slid in the other direction; an actuator member on the cage structure; two limit switches to stop and/or reverse the electric motor, the two limit switches positioned on each side of the actuator member, one limit switch activated when the worm slides on the motor shaft a predetermined distance in one direction, and the second limit switch activated when the worm slides on the motor shaft in the other direction; adjustment means to vary the position of the two limit switches, and an indicator light for each limit switch indicating when each limit switch is activated.

In other embodiments, the two compression springs are preferably coil springs supported on a separate shaft parallel to the motor drive shaft, thus providing a compact mechanism. In a further embodiment the worm is keyed to the motor drive shaft and is able to slide axially on the shaft. In yet a further embodiment, the indicator lights are on when power to the motor is on and the indicator lights are off when power to the motor is off.

In drawings which illustrate embodiments of the invention:

FIG. 1 is an isometric view illustrating one embodiment of a powered door operating device as known in the prior art wherein a friction roller drives up and down on one of two guide tracks for a vertical door;

FIG. 2 a cross sectional side view illustrating the drive mechanism with the stopping or reversing mechanism according to one embodiment of the present invention;

FIG. 3 is a cross sectional view taken at line 3—3 of FIG. 2;

FIG. 5 is a cross sectional view taken at line 5—5 of FIG. 2;

Figure 6:
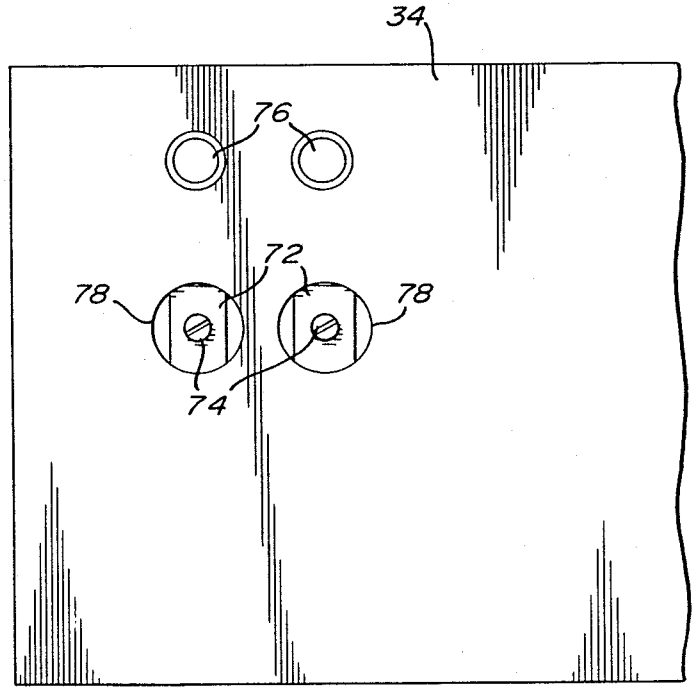
FIG. 6 is a back side view of the power door operating device as shown in FIG. 2.

Referring now to FIG. 1, one side of a garage door 10 is shown comprising a series of panels 12 hinged together at horizontal edges and having rollers (not shown) which fit into guide tracks 14 on each side of the door 10. The guide track 14 has a bend above the door and then extends substantially horizontally for a distance sufficient to hold the complete door when it is raised. A power door operating device 16 is shown attached to the door by a mounting bracket 18, the operating device 16 has a drive roller 20 with a peripheral groove at it's approximate center which rides on the outside curved flange 22 of the track 14. This type of power door operating device is shown in my U.S. Pat. No. 4,625,456. Other types of operating devices include an operating device which is located above the door and operates the door by means of a chain sprocket, a pulley or a cable drum as disclosed in my U.S. Pat. No. 3,633,313. The present invention may be utilized with any type of power door operating device that includes an electric motor having a worm and worm gear drive mechanism.

Figure 2:
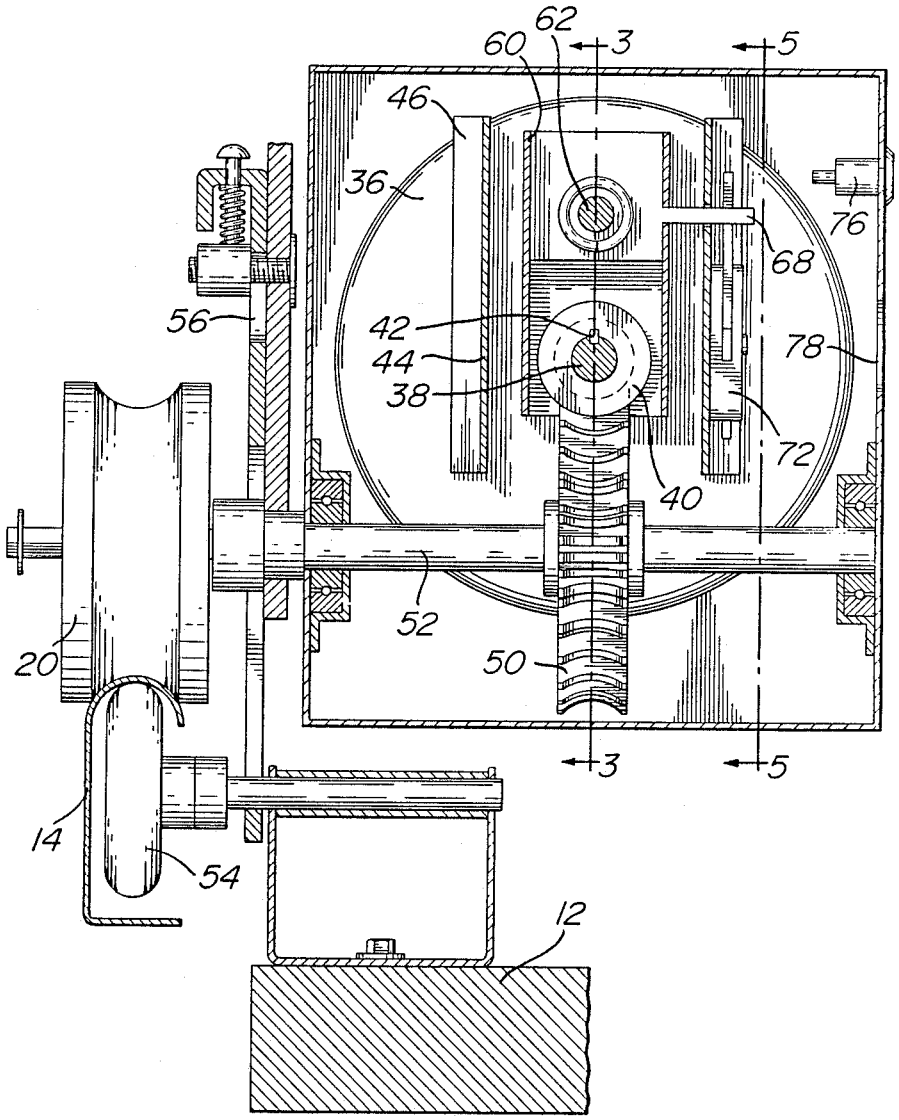
Figure 4:
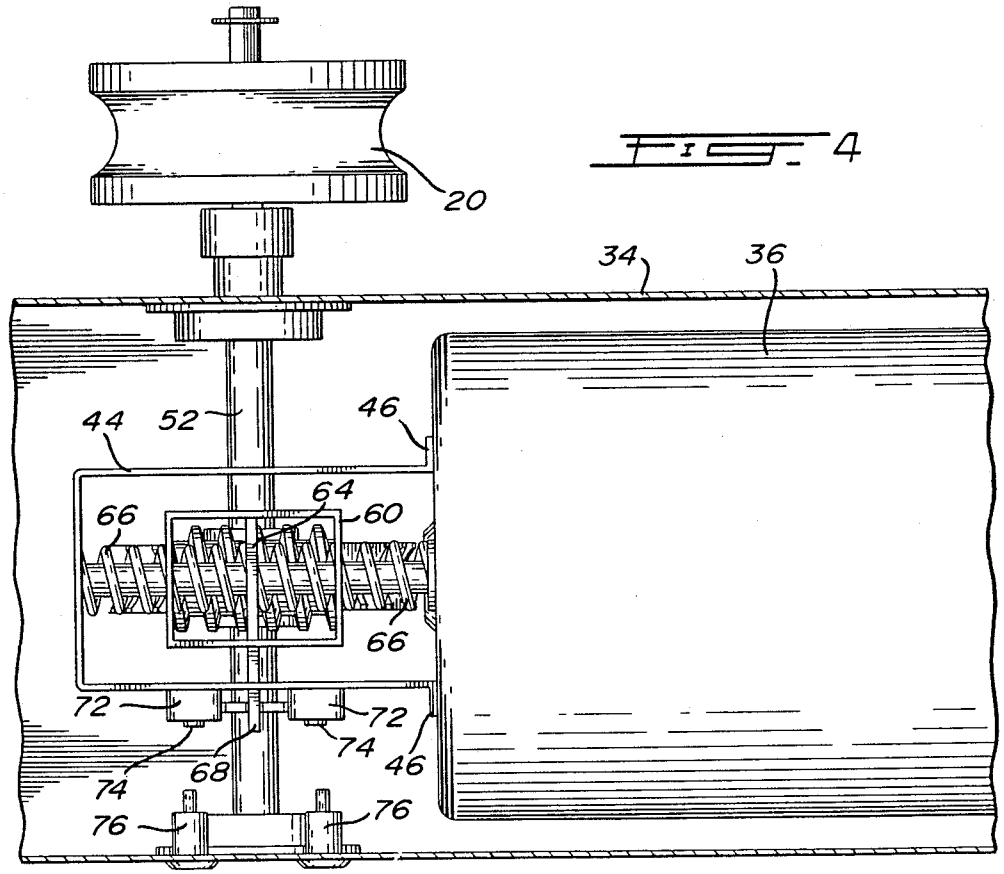
FIG. 4 is a top view of the power door operating device shown in FIG. 2.
Figure 7:
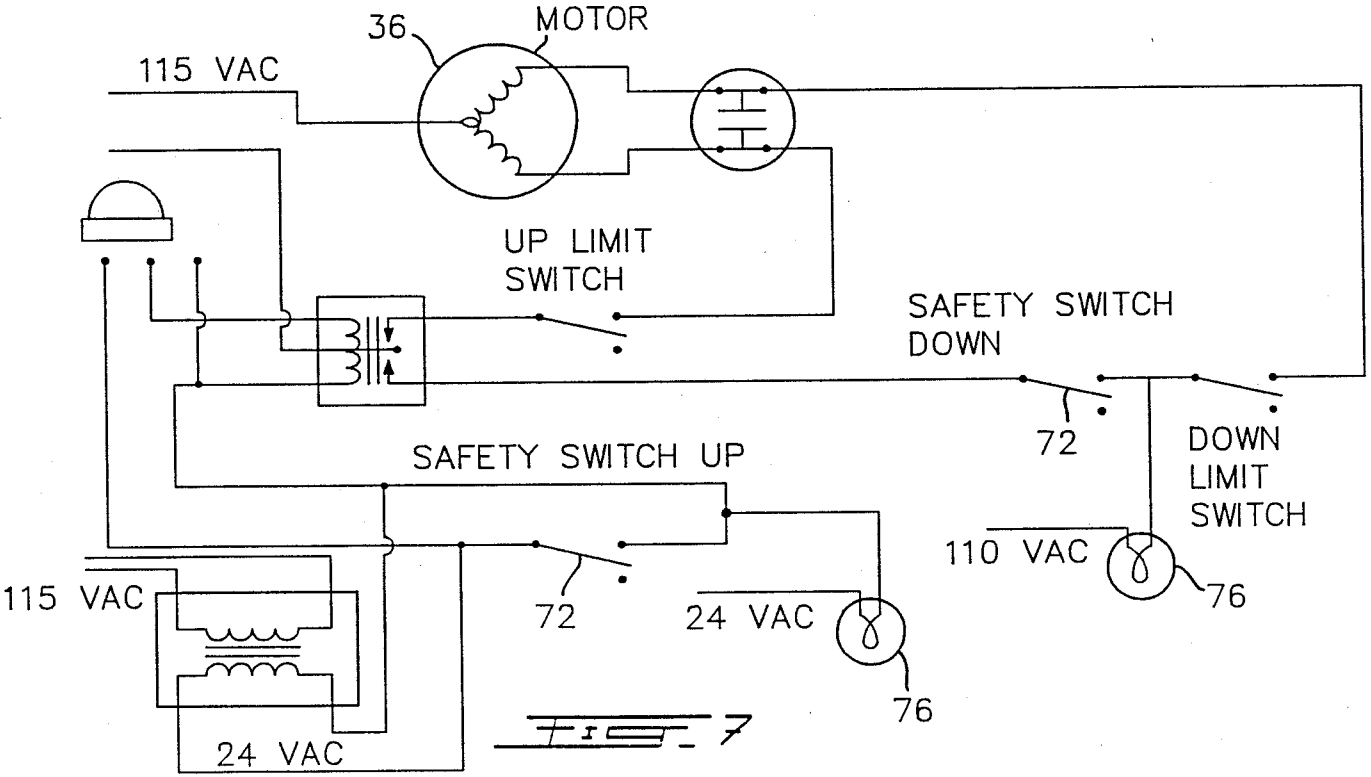

The door operating device is illustrated in FIGS. 2 to 6 and has a housing 34, generally a sheet metal construction, containing a reversable electric motor 36 having a motor drive shaft 38 extending from the motor and having a worm 40 fitting over the shaft and slidingly engaged on the shaft 38. A key 42 is provided on the motor shaft 38 and allows the worm 40 to slide up and down the shaft, but holds the worm 40 in rotational engagement on the shaft 38. A U-shaped sheet metal bracket 44 is attached at flanges 46 to the face of the motor 36 and supports the end of the motor drive shaft 38 in a bearing 48. The worm 40 engages a worm gear 50 which is keyed and locked to a power drive shaft 52. As shown in FIG. 2, the drive shaft 52 extends out to the drive roller 20 on the guide track 14. A freely rotating guide roller 54 rests on the inside of the guide track 14 squeezing it between the guide roller 54 and the drive roller 20. A disengaging mechanism 56 is illustrated for disengaging the drive roller 20 to provide manual operation for the door.

The worm 40 has a cage structure 60 which surrounds it and moves up and down the motor shaft 38 as the worm 40 moves. A spring shaft 62 is positioned above the motor shaft 38 parallel thereto extending from the face of the motor 36 to the end of the bracket 44. The cage structure 60 has a center member 64 which fits over the spring shaft 62 and is positioned in the approximate center of the cage structure 60. Two springs 66 are provided on the spring shaft 62 positioned on each side of the center member 64 of the cage structure 60. When the worm 40 is approximately in the center position with regards to the axis of the worm gear 50, then the two springs 66 provide an even pressure on the center member 64. This is the normal operating position when there are no obstructions preventing the door from opening and closing.

An actuator member 68 extends from the center member 64 of the cage structure 60 through an aperture 70 in the bracket 44. Two limit switches 72, each having screw location adjustments 74, are tripped by the actuator member 68 when the worm 40 moves in either direction on the motor shaft 38. Two indicator lights 76 are provided on the outside of the housing 34 and apertures 78 are provided in the housing 34 to reach the adjustment screws 74 for the two limit switches 72.

Figure 7:
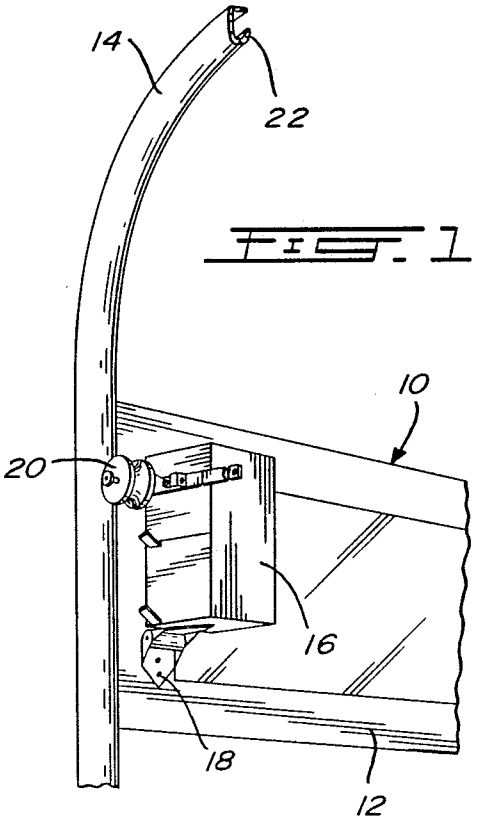
FIG. 7 is a wiring diagram for the stopping or reversing mechanism and the indicator lights according to one embodiment of the present invention.

FIG. 7 illustrates a wiring diagram showing the safety switch up and safety switch down representing two limit switches 72 illustrated, and the indicator lights 76 thereon. An up limit switch and a down limit switch shown in the wiring diagram provide upper and lower limits for the movement of the door. These limit switches are separate to the safety switches which are operated when the door hits an obstacle or becomes jammed.

In operation, when the motor 36 starts turning in one direction, the worm 40 drives the worm gear 50 which in turn rotates the power drive shaft 52. When there is no obstruction to restrict rotation of the worm gear 50, the two compression springs 66 keep the cage structure 60, and hence the worm 40, in it's neutral or central position. When the door is either going up or down and encounters an obstacle or, alternatively, becomes jammed, then the worm gear 50 stops turning and the worm 40 continues rotating and thus slides along the motor shaft 38 moving the cage structure 60. One of the springs 66 is compressed until the actuator member 68 trips one of the limit switches 72, which either turns off the motor or if the door is closing, then reverses the motor so the door moves upwards. The indicator lights 76 provide a visual indicator to show exactly when the limit switches 72 are tripped by the actuator member 68. One indicator light 72 is connected to the up limit switch and the other indicator light 76 is connected to the down limit switch 72. Both indicator lights are off when the electrical power to the motor is cut off by the limit switches. When the limit switches are not tripped and electrical power is on to the motor, then the indicator lights 72 are on.

In order to exactly adjust the sensitivity of the door, the adjustment screws 74 for each limit switch 72 are adjusted to suit each particular door. When there is a restriction to movement and the limit switch has been tripped, then the indicator lights are off. By turning the adjustment screws 74, the position of the limit switch finger moves, and the indicator light goes on telling the door installer that the desired sensitivity for the door operating mechanism has been obtained. The same occurs for both the up limit switch and the down limit switch, consequently it is not necessary to guess as to the sensitivity of the door, but adjust the position of the limit switch finger to turn on the light indicating the door trip pressure. It is also simple for a householder to check this pressure from time to time by merely checking when the indicator lights go off and adjusting the limit switch adjustment screws 74 accordingly.

The safety mechanism of the present invention is more compact than that shown in my U.S. Pat. No. 3,633,313 because it has two shafts and takes up only one half the length of shaft as was needed for the other mechanism. This is particularly useful in the type of drive mechanism illustrated in FIG. 1.

Various changes may be made to the embodiments described herein without departing from the scope of the present invention which is limited only by the following claims.

The embodiments of the invention in which an exclusive property or privilege is claimed are defined as follows.

1. In a power door operating devicefor use with a vertical sliding door, including a door opening and closing means, the improvement of a stopping or reversing mechanism for the sliding door comprising:

a reversable electric motor having a motor drive shaft extending therefrom;

a worm slidably mounted on the motor drive shaft and held in rotational engagement to the motor drive shaft;

a worm gear in working engagement with the worm, the worm gear locked onto a power drive shaft connected to the door opening and closing means;

a cage structure around the worm adapted to slide with the worm;

two compression springs supporting the cage structure so that at the neutral position, the worm is at about the mid point of engagement with the worm gear, such that slidable movement of the worm on the motor shaft compresses one spring if slid in one direction, and the other spring if slid in the other direction;

an actuator member on the cage structure;

two limit switches to stop and/or reverse the electric motor, the two limit switches positioned on each side of the actuator member, one limit switch activated when the worm slides on the motor shaft a predetermined distance in one direction, and the second limit switch activated when the worm slides on the motor shaft in the other direction;

adjustment means to vary the position of the two limit switches, and an indicator light for each limit switch indicating when each limit switch is activated.

2. The power door operating device according to claim 1 wherein the two compression springs are coil springs supported on a separate shaft parallel to the motor drive shaft.

3. The power door operated device according to claim 1 wherein the worm is keyed to the motor drive shaft.

4. The power door operating device according to claim 1 wherein the indicator lights are off when power to the motor is off and the indicator lights are on when power to the motor is on.

* * * * *